US007075860B2

(12) United States Patent
Dias

(10) Patent No.: US 7,075,860 B2
(45) Date of Patent: Jul. 11, 2006

(54) MECHANICAL HOUR AND MINUTE DISPLAY DEVICE

(75) Inventor: Carlos Dias, Carouge (CH)

(73) Assignee: Manufacture Roger Dubuis S.A., Meyrin (CH)

( * ) Notice: Subject to any disclaimer, the term of this patent is extended or adjusted under 35 U.S.C. 154(b) by 0 days.

(21) Appl. No.: 11/074,407

(22) Filed: Mar. 8, 2005

(65) Prior Publication Data

US 2005/0152225 A1 Jul. 14, 2005

Related U.S. Application Data

(63) Continuation of application No. PCT/CH2003/000645, filed on Sep. 9, 2003.

(30) Foreign Application Priority Data

Oct. 1, 2002 (EP) ..... 02405843

(51) Int. Cl.
*G04B 19/20* (2006.01)

(52) U.S. Cl. ..... 368/77; 368/221; 368/233

(58) Field of Classification Search ..... 368/76, 368/77, 223, 232, 233, 221, 163
See application file for complete search history.

(56) References Cited

U.S. PATENT DOCUMENTS

| | | | | |
|---|---|---|---|---|
| 359,227 | A * | 3/1887 | Pallweber | 368/221 |
| 2,130,873 | A * | 9/1938 | Bourquin | 368/77 |
| 2,636,339 | A * | 4/1953 | Holzner | 368/78 |
| 2,645,896 | A * | 7/1953 | Uhlig et al. | 368/222 |
| 2,734,338 | A * | 2/1956 | Uhlig et al. | 368/78 |
| 3,673,787 | A * | 7/1972 | Kovacevic | 368/78 |
| 3,712,048 | A * | 1/1973 | Bachmann | 368/79 |
| 3,854,280 | A * | 12/1974 | Wuthrich | 368/76 |
| 3,930,359 | A * | 1/1976 | Flumm et al. | 368/221 |
| 3,982,388 | A * | 9/1976 | Guyot et al. | 200/38 FA |
| 5,581,520 | A * | 12/1996 | Ogden | 368/35 |
| | | | | 368/76 |

FOREIGN PATENT DOCUMENTS

| | | |
|---|---|---|
| DE | 546332 | 3/1932 |
| FR | 2257935 | 8/1975 |

* cited by examiner

*Primary Examiner*—Kamand Cuneo
*Assistant Examiner*—Jeanne-Marguerite Goodwin
(74) *Attorney, Agent, or Firm*—Sturm & Fix LLP

(57) ABSTRACT

This hour and minute display device comprises four disks, two for displaying, respectively, the tens and units of hours, two for displaying, respectively, the tens and units of minutes, each disk being fixedly connected to a toothed wheel linked to a jumper, said toothed wheels, fixedly connected to the two disks for displaying, respectively, the units of hours and of minutes, being linked to respective yoke mechanisms pressed by elastic members against respective instantaneous-jump cam elements, and further comprises, between said cam elements and the toothed wheels fixedly connected, respectively, to said tens of minutes and of hours disks, mechanisms for connecting these latter toothed wheels to said respective instantaneous-jump cam elements with each change of tens.

10 Claims, 8 Drawing Sheets

Figure 7
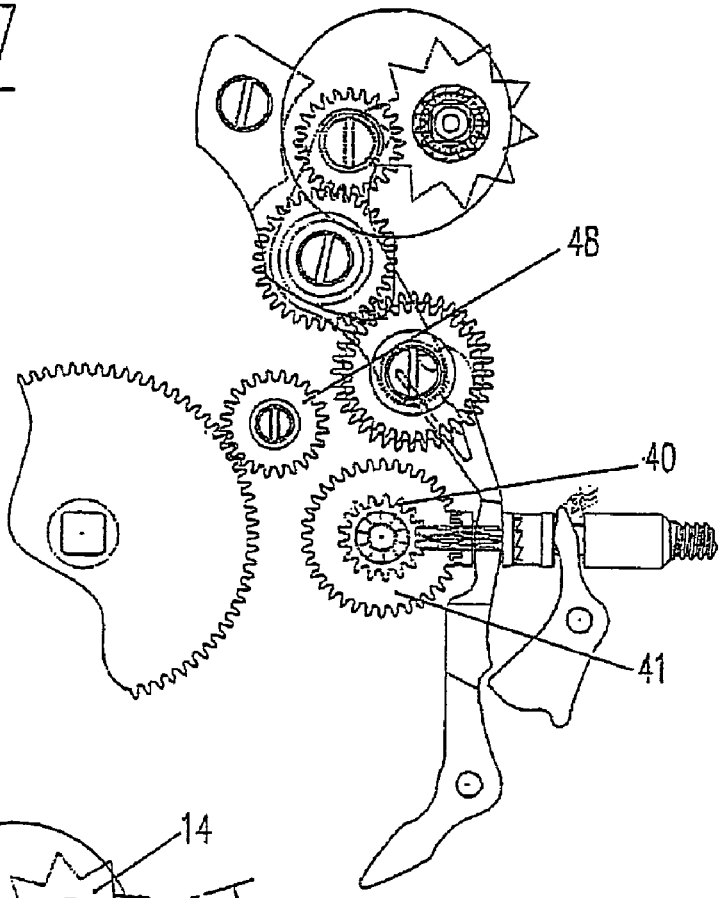
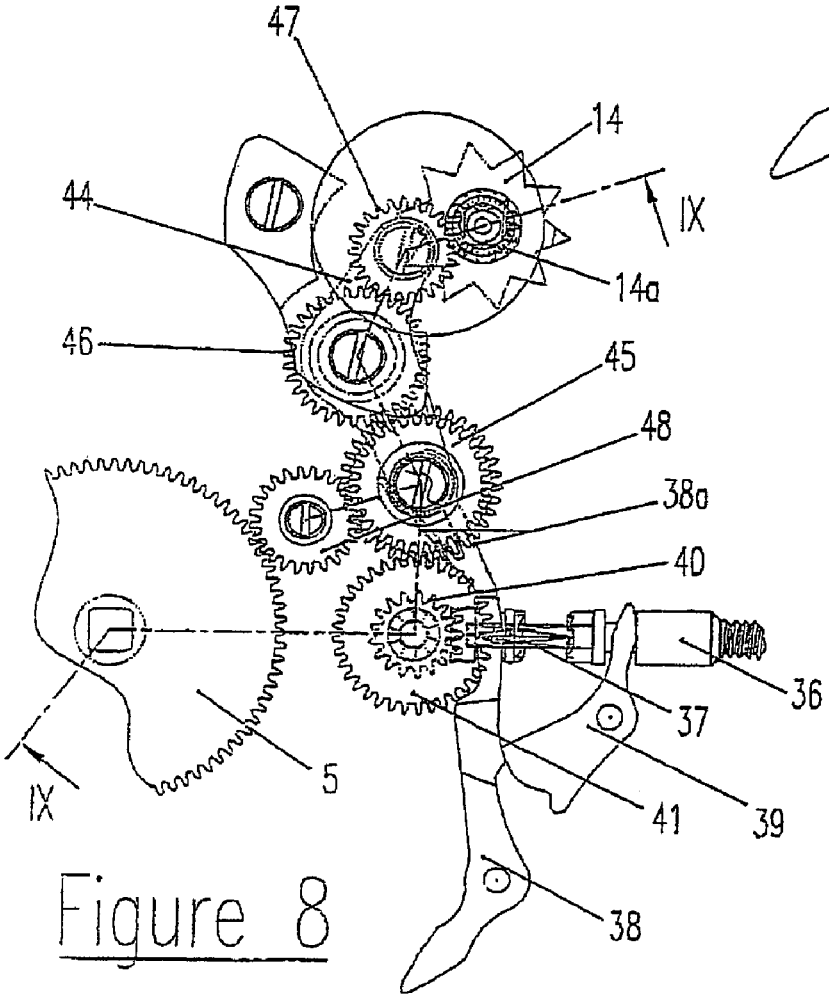
Figure 8

MECHANICAL HOUR AND MINUTE DISPLAY DEVICE

CROSS REFERENCE TO RELATED APPLICATIONS

This application is a continuation of PCT/CH2003/000645 filed Sep. 9, 2003, which claims priority of European Application No. 02405843.0 filed Oct. 1, 2002, and are included herein in their entirety by reference made hereto.

BACKGROUND OF THE INVENTION

1. Field of the Invention

The present invention relates to a mechanical hour and minute display device.

2. Description of Related Art

Although the digital hour and minute display using liquid crystals or electroluminescent diodes is known for quartz watches, it is virtually unknown in the case of mechanical watches. Even though some attempts have been made, a display device in which the changes of hours and minutes are all of the instantaneous jump variety is in any event unknown. Nor is there known a digital mechanical display device for a watch, in which all the digits are disposed side by side, allowing easy reading, and are equal in size and large enough to be read without a magnifier, which presupposes that the device displays the units and tens separately, both for the hours and for the minutes.

BRIEF SUMMARY OF THE INVENTION

The precise object of the present invention is to overcome the difficulties inherent to the digital display of hours and minutes by mechanical means, the effect of which is to double the number of display elements relative to the conventional analog display.

To this end, the subject of this invention is a mechanical hour and minute display device as defined by the claims.

The benefit of the display device forming the subject of the present invention is to allow the instantaneous digital display of hours and minutes by mechanical means.

BRIEF DESCRIPTION OF THE DRAWINGS

The appended drawing illustrates diagrammatically and by way of example an embodiment of the display device forming the subject of the present invention.

FIG. 7 is a partial top view of FIG. 2, illustrating the display-correcting mechanism in the disengaged position;

FIG. 8 is a view similar to FIG. 7, illustrating the display-correcting mechanism in the engaged position;

DETAILED DESCRIPTION OF THE INVENTION

The timepiece which is illustrated here by way of example comprises several indications derived from the hour, in particular the days of the week, the day of the month, the phase of the moon and the daytime and nighttime hours. It is straightaway made clear that these other indications are illustrated only by way of options, but that the present invention is not limited to their presence in association with the hour and minute display.

Figure 1:
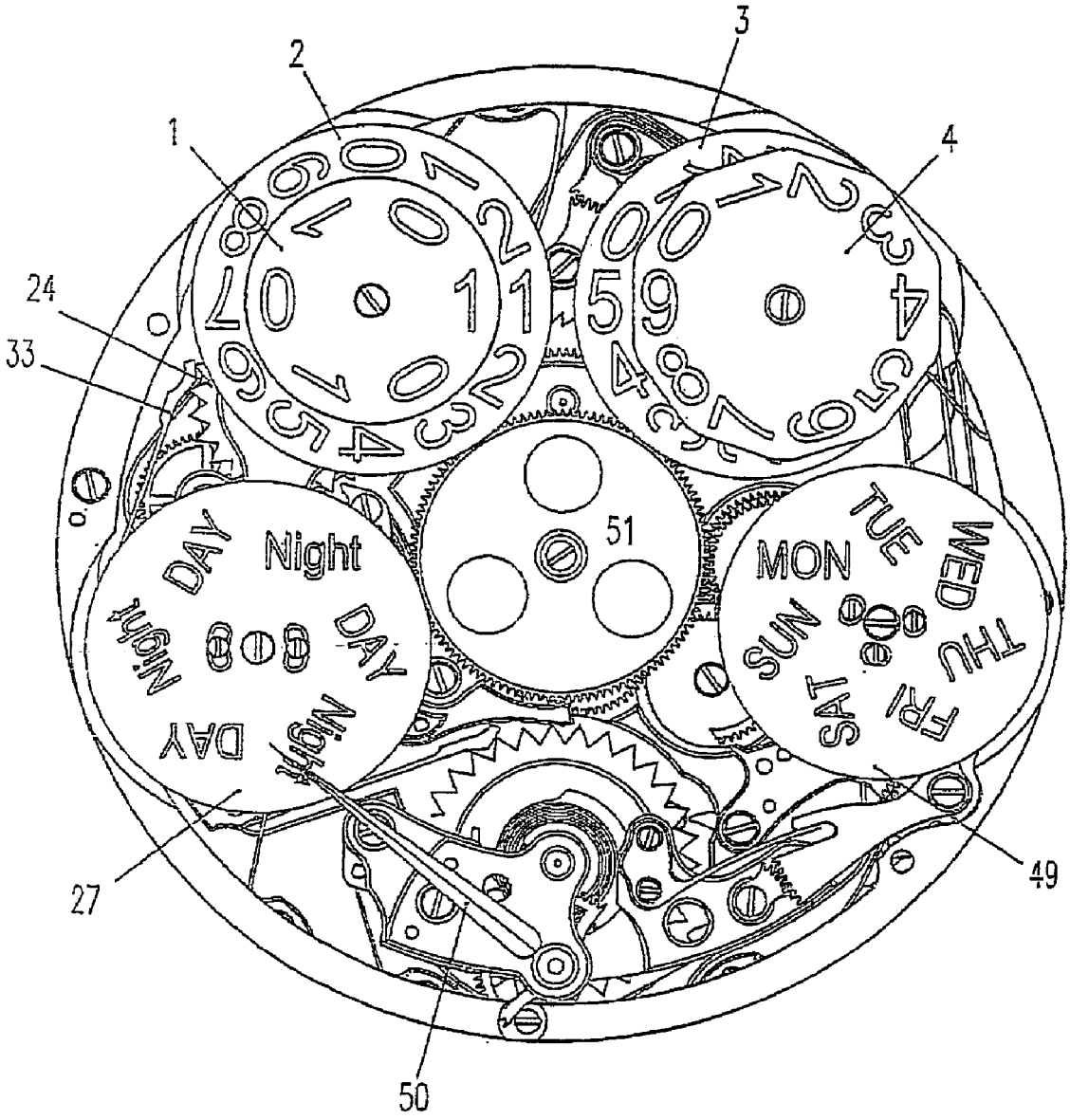
FIG. 1 is a top view of the whole of the mechanical display of the timepiece comprising the hour and minute display device forming the subject of the invention.

It can be seen in FIG. 1 that the hours are indicated by two concentric disks 1, 2 respectively bearing the tens digits (0, 1 for an hour display by blocks of twelve hours) and the ten units digits, that the minutes are indicated by two non-concentric disks 3, 4 respectively bearing the tens digits (0 to 5) and the ten units digits.

Figure 4:
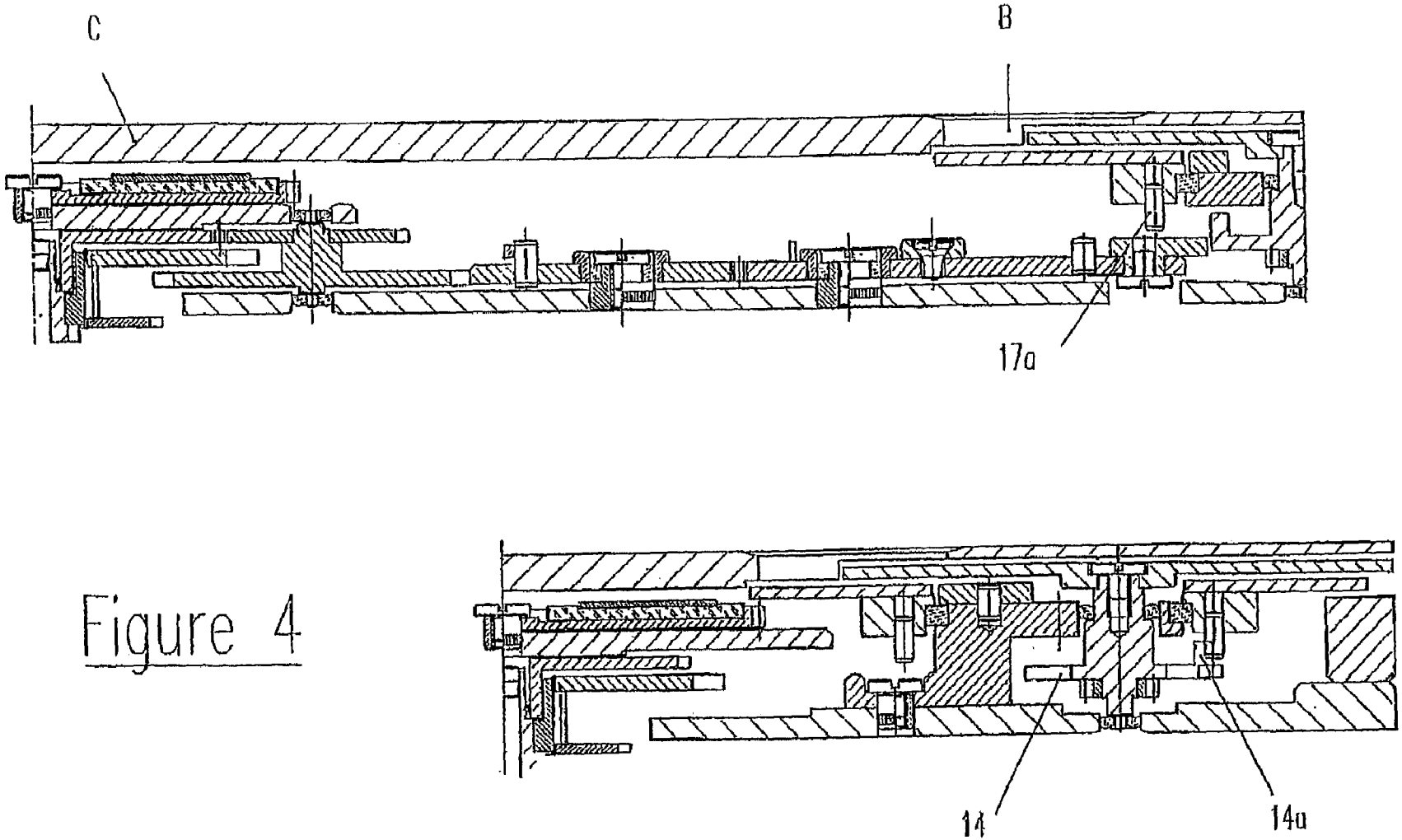
FIG. 4 is a sectional view along the line IV—IV of FIG. 3.

Two side-by-side digits of the pair of hour disks 1, 2 are aligned with two adjacent digits of the pair of minute disks 3, 4. These two adjacent pairs of aligned digits of the hour disks 1, 2 and minute disks 3, 4, respectively, appear through two rectangular windows, A and B respectively, arranged through the dial plate of the watch C (FIGS. 4 and 6), which dial plate covers over the different display disks illustrated by FIG. 1, in the style of windows currently in use, particularly to indicate the days of the month. In the position of the disks 1, 2, 3, 4 in the illustrated example, it will hence be possible to read through these windows A, B that it is 11 hours and 59 minutes.

Figure 3:
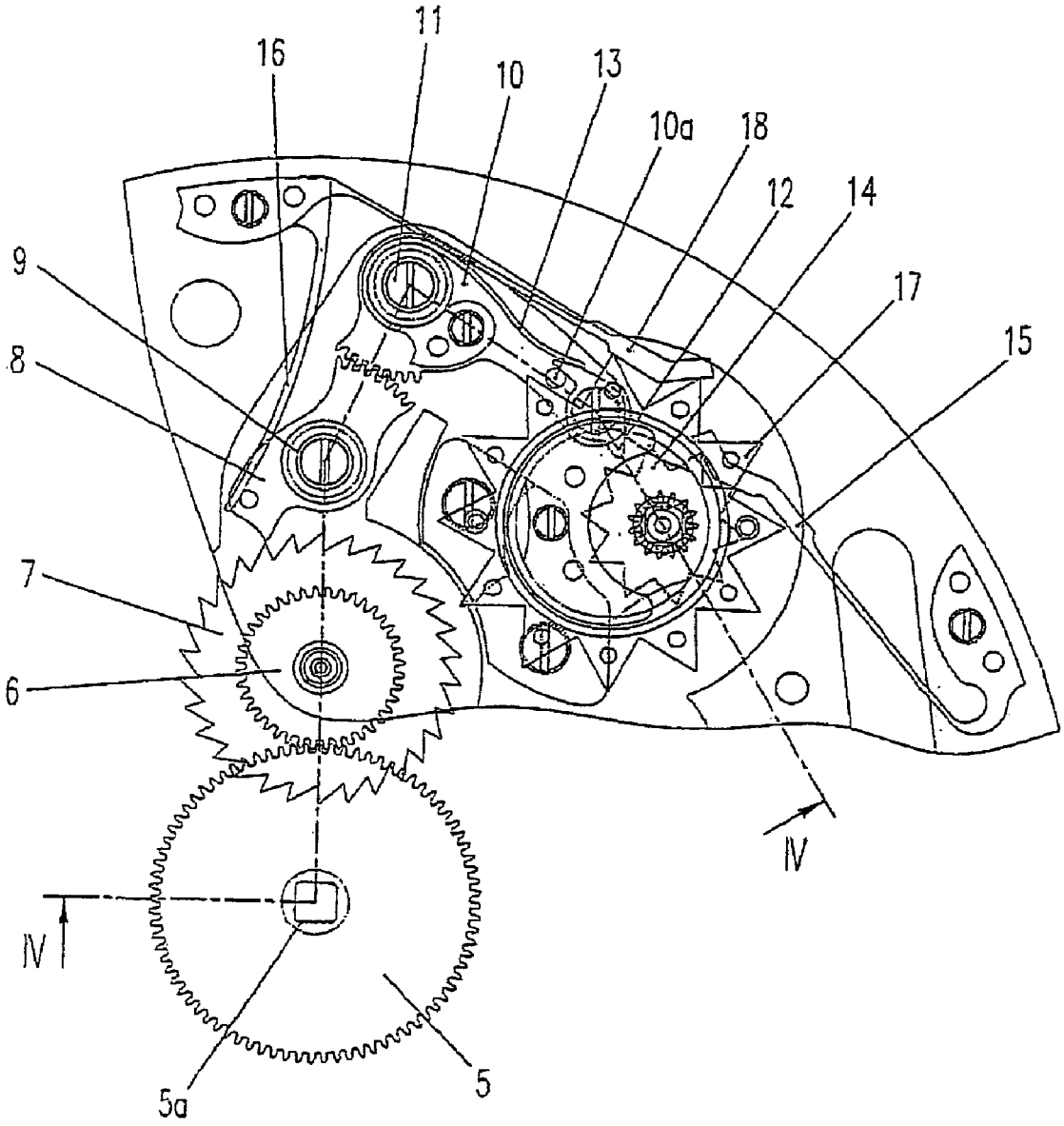
FIG. 3 is a partial top view of FIG. 2, illustrating the minute display mechanism.

The drive mechanism of the minute disks 3, 4 (FIGS. 3, 4) comprises a drive wheel 5 situated in the center of the watch movement. The center of this drive wheel 5 has a square opening 5*a*, which adopts a position over a same-section portion of the cannon pinion (not represented) of the conventional watch movement, such that this drive wheel 5 rotates at the rate of 1 turn/hour. It meshes with a minute mobile 6 with a 2/1 ratio, such that this minute wheel makes two turns per hour. It is fixedly connected to an instantaneous-jump minute wheel 7 comprising 30 triangular teeth, each tooth of which constitutes an instantaneous-jump cam. To this end, one of the faces of each tooth has a radial orientation relative to the center of the wheel 7, whereas the other is inclined and constitutes a winding ramp.

An intermediate yoke 8 is mounted pivotably about an axis by a fastening screw 9. This yoke 8 comprises a toothing engaged with a toothing of a minute yoke 10 mounted pivotably about an axis by a fastening screw 11. This minute yoke 10 bears a drive pawl 12 pressed against a stop 10*a* of the yoke 10 by a spring 13. This drive pawl 12 is engaged with a toothing of a toothed star wheel 14 of ten triangular teeth, which is fixedly connected to the units of minutes disk 4. This toothed star wheel 14 is positioned by a jumper spring 15.

A spring 16 tends constantly to rotate the intermediate yoke 8 in the reverse direction to that of the watch hands, thus maintaining a permanent contact between this yoke 8 and one of the teeth or cam of the instantaneous-jump wheel 7. Given the connection between the yokes 8 and 10 by their respective toothed sectors, the minute yoke 10 is displaced in the direction of the watch hands when the intermediate yoke 8 is displaced in the opposite direction, and vice versa.

The tens of minutes disk 3 is fixedly connected to a toothed star wheel 17 comprising twelve triangular teeth, positioned by a jumper spring 18. This wheel 17 is offset relative to the toothed star wheel 14 fixedly connected to the units of minutes disk 4. The relative positions of the two toothed star wheels 14, 17 are such that there is a zone in which their respective toothings lie one on top of the other. A pin 17*a* is fixed to the center of each triangular tooth, perpendicularly to the plane of the toothed star wheel 17, whereby addendums are formed. These pins extend in the direction of the toothed star wheel 14, one of whose ten teeth 14*a* (FIG. 4) is thicker than the rest of this wheel 14, thus forming an addendum directed toward the star wheel 17, such that this tooth 14*a* intersects the trajectory of the pins 17*a* and advances the star wheel 17 by one step with each turn of the star wheel 14. Since this wheel 14 has ten teeth, it therefore advances the star wheel 17 fixedly connected to the tens of minutes disk 4 by one step with each change of ten. Moreover, given that the wheel 14 is driven by instantaneous jumps, the wheel 17 is therefore also, in turn, driven by instantaneous jumps. Since this star wheel 17 has twelve teeth, it will therefore make one turn in two hours, and the disk 4 which is fixedly connected thereto hence bears two series of digits 0 to 5.

Figure 5:
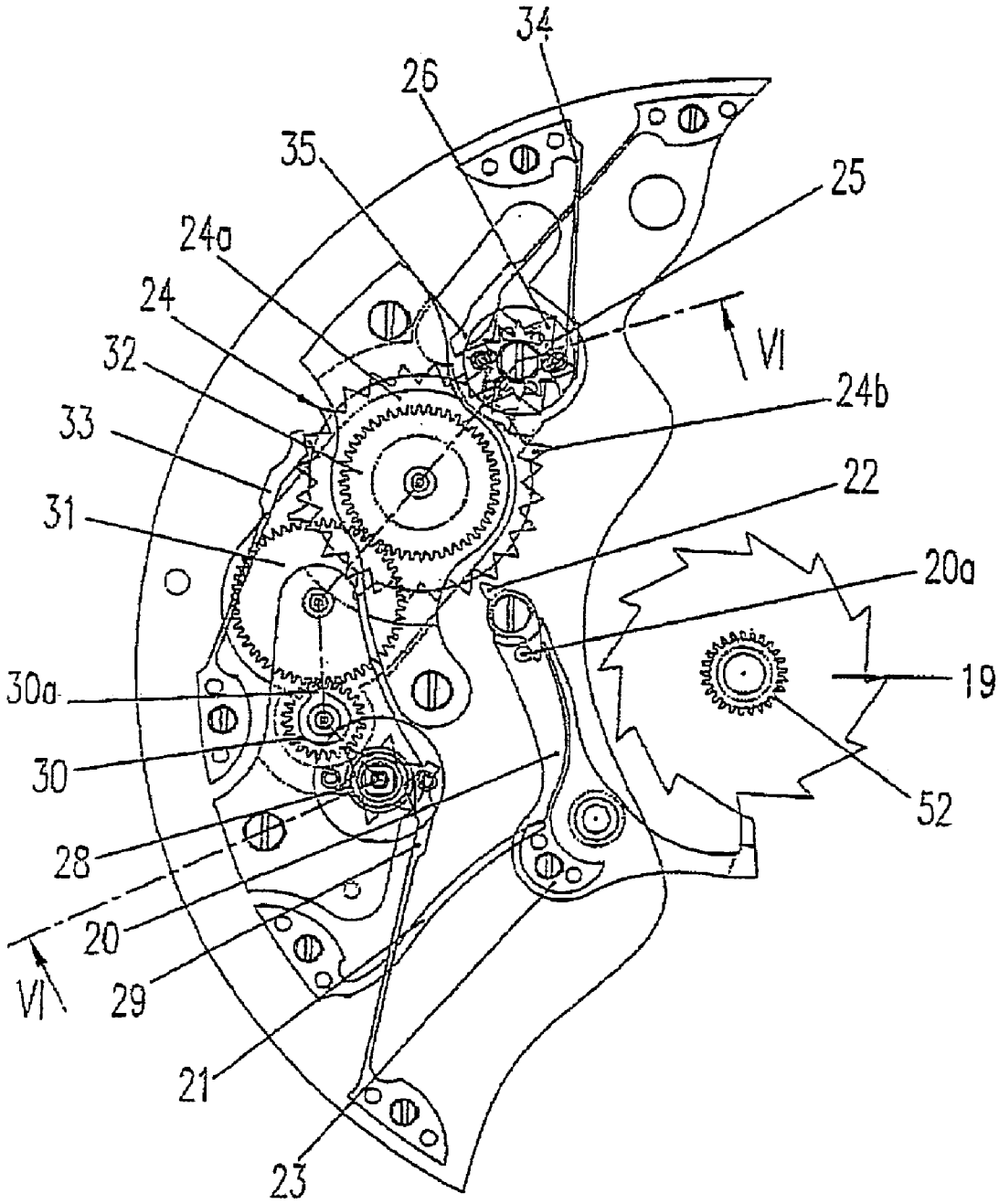
FIG. 5 is another partial top view of FIG. 2, illustrating the mechanism for displaying the hours and daytime and nighttime hours.
Figure 6:
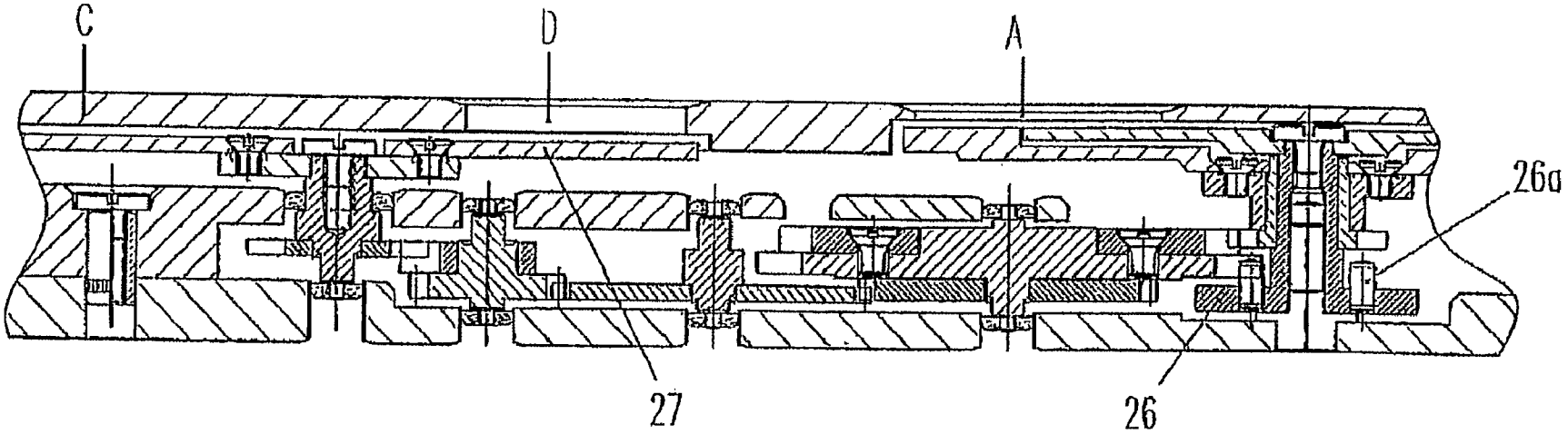
FIG. 6 is a sectional view along the line VI—VI of FIG. 5.

The hour display mechanism FIGS. 5, 6) comprises an instantaneous-jump hour cam wheel 19, coaxial with the minute drive wheel 5, but which is fixedly connected to the cannon wheel (not represented) of the conventional work train, such that it makes one turn in twelve hours and rotates in the direction of the watch hands. This wheel 19 comprises twelve cams in the form of triangular teeth, one of whose respective faces has a radial orientation.

One end of an instantaneous-jump yoke 20 is pressed by a spring 21 against the cam wheel 19. The other end of this yoke bears a click 22, pressed against a stop 20*a* by a spring 23. This click 22 is engaged with a toothing of a 24-tooth gear 24*a* of a mobile 24, which makes one turn in 24 hours. This mobile 24 comprises a second toothing of a second, four-tooth gear 24*b*, arranged symmetrically in pairs. The two gears 24*a*, 24*b* are fixedly connected one to the other and coaxial one with the other. The toothing of the gear 24*a* is positioned by a jumper spring 33.

The toothing 24*a* of the wheel 24 is engaged with a twelve-tooth toothed star wheel 25 fixedly connected to the units of hours disk 2 and positioned by a jumper spring 34, whereas the teeth 24*b* are engaged with a six-tooth toothed star wheel 26, fixedly connected to the tens of hours disk 1 and positioned by a jumper spring 35. The connection between the teeth 24*b* and the star wheel 26 is not realized by the teeth of this wheel 26, but by pins 26*a* (FIG. 6), which project perpendicularly to this star wheel 26. The angular positions of the four teeth 24*b* of the toothing are chosen so as to drive the star wheel 26 for a first time, with the passage of the units to that of the ten, and for a second time, after the display of the digit 12, so as to revert to the units, this cycle recurring for a second time in 24 hours. Of course, in the example which is given here, the display is realized by dividing the one-day period into two periods of 12 hours.

An indication allows information to be given which is intended to differentiate between the hours of the day and those of the night. To this end, a disk 27 (FIGS. 1 and 6) which moves beneath a window D is fixed to a star wheel 28 (FIGS. 5 and 6) positioned by a jumper spring 29. This star wheel 28 is advanced every 12 hours by a finger 30*a* fixedly connected to a pinion 30, which makes two turns in 24 hours and is driven by a wheel 31 engaged with a wheel 32 coaxial with and fixedly connected to the wheel 24. The disk 27 bears indications capable of differentiating between the two periods of 12 hours. The two periods indicated by the disk 27 each have 12 hours. It does not necessarily coincide with the 12-hour periods of the hour display disks 1, 2. In fact, if the disk 27 differentiates between day and night, the start of each period may commence, for example, at 6 a.m. and 6 p.m. respectively. If the disk 27 indicates the hours in the Anglo-Saxon manner, it can bear the indications AM and PM and, in this case, the periods will coincide with the two 12-hour periods of the disks 1, 2.

The instantaneous-jump display mechanism which has just been described has the peculiarity that its different elements cannot rotate in the reverse direction to that of the watch hands. In fact, the presence of the cam wheels 7 and 19, the triangular teeth of which each comprise one side with radial orientation, only allows rotation in one direction, since in the opposite direction the radial flanks of the teeth jam the wheel when the yoke is at the bottom of a space separating two teeth. If these trains could be driven in both directions, as in other watches, great damage could be done to the watch movement.

Even were this problem of the direction of rotation of the train to be solved, if the time-setting had to be carried out through the instantaneous jump mechanism of the minute display mechanism, then the time-setting would take an extremely long time to perform owing to the step-by-step advancement of the toothed star wheel 14 by the yokes mechanism 8, 10 and owing to the speed, which is necessarily limited to that at which this mechanism can be driven.

This is the reason why a particular time-setting mechanism has been realized in order to satisfy the two aforementioned requirements. This mechanism comprises a conventional winding stem 36 on which is mounted a wholly conventional sliding pinion 37, which slides in a conventional manner over a square-sectioned portion of the winding stem 36, such that this sliding pinion 37 is rotationally fixedly connected to this winding stem regardless of its position along this winding stem 36. This sliding pinion 37, like all conventional sliding pinions, comprises a groove in which a yoke 38 is engaged. This yoke 38 is actuated by a pivotably mounted setting lever 39, one finger of which is engaged, in a customary manner, in a groove in the winding stem. Upon axial displacements of the winding stem 36, the setting lever 39 pivots and actuates the pivoting of the yoke 38, which displaces the sliding pinion 37 in two positions illustrated respectively by FIGS. 7 and 8.

Figure 9:
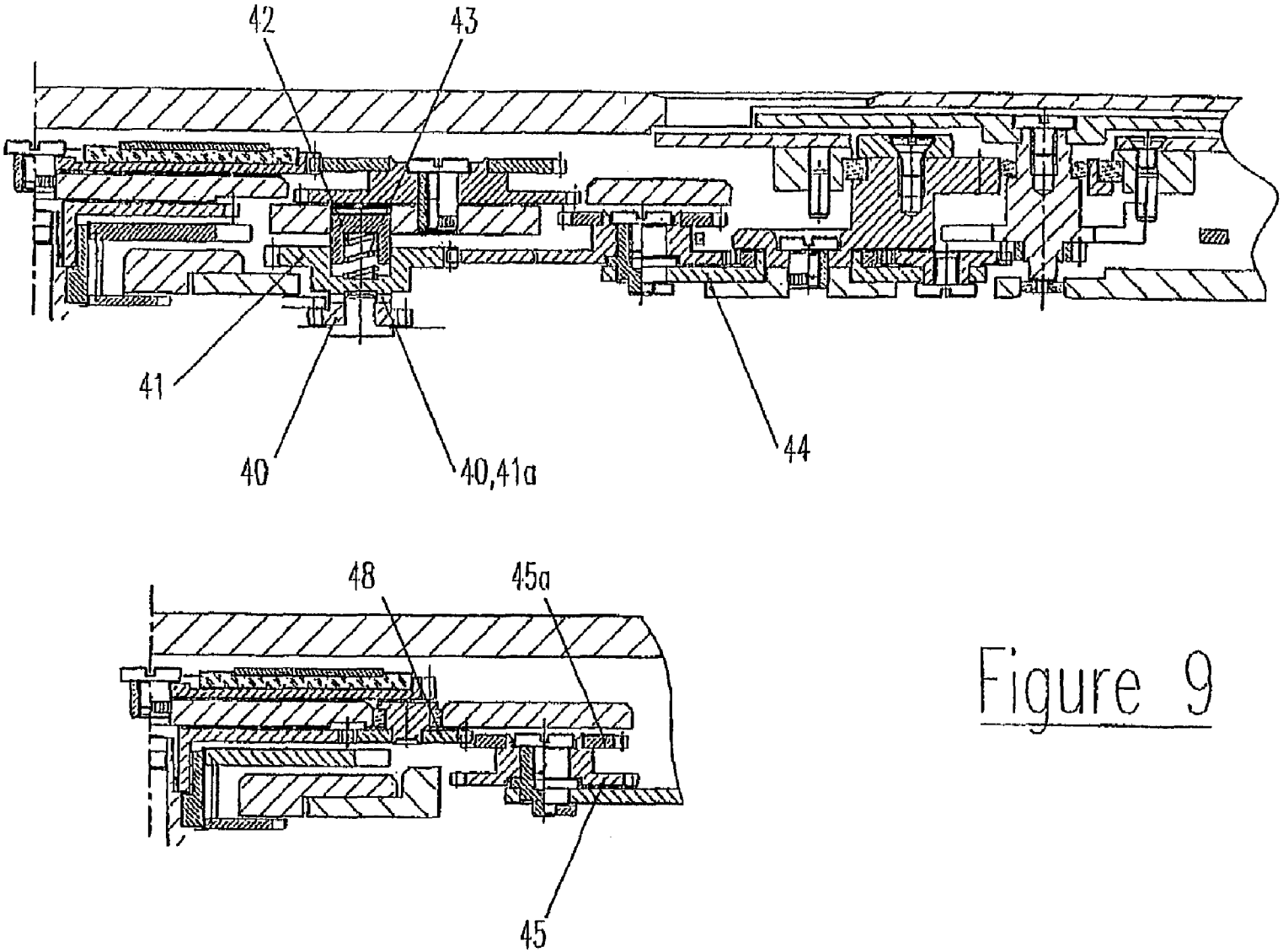
FIG. 9 is a sectional view along the line IX—IX of FIG. 8.

When the sliding pinion 37 is in the position illustrated by FIG. 8, that is to say in the time-setting position, its edge toothing is engaged with a time-setting gear 40. This gear 40 has Breguet-type edge toothing 40*a* (FIG. 9), engaged with an edge toothing 41*a*, likewise of the Breguet type, fixedly connected to a second, coaxial gear 41. The second gear 41 is mounted pivotably on a tubular pivot element 42 in which a helical spring 43 is housed. This spring 43 presses together the two sawtooth toothings 40*a*, 41*a*, such that the gear 40 transmits its rotation to the gear 41 only in one direction, since in the other direction the sawtooth toothings disengage and bring about the disengagement of the gear 41, the latter being able to slide axially over the tubular pivot element 42. This arrangement therefore allows the hour and minute display mechanisms to be driven only in the desired direction, thus avoiding all risk of damage to these mechanisms.

The yoke 38 is terminated by two arms which form a gripping element 38*a* and between which there is situated one end of a correcting yoke 44, which supports three gears 45, 46, 47 and which is pivoted coaxially with the gear 46. In that winding position of the time-setting mechanism which is illustrated by FIG. 7, the three gears 45, 46, 47 are disconnected from the gear 41 and from the pinion 14*a* fixedly connected to the units of minutes star wheel 14.

When the winding stem 36 displaces the time-setting mechanism in the position illustrated by FIG. 8, the correcting yoke 44 is displaced and, at the same time, meshes the gear 45 with the gear 41 and the gear 47 with the pinion 14*a* of the units of minutes display star wheel 14. This correcting yoke 44 constitutes a mechanism for establishing a direct connection between the sliding pinion 37 and the units of minutes display star wheel 14.

By virtue of this arrangement, the instantaneous-jump drive mechanism of the star wheel 14 is disabled, the displacement of the disks 3 and 4 being effected by means of the gears 41, 45, 46, 47 and the pinion 14*a,* which allows a much more rapid time-setting than by passing through the mechanism of the yokes 8 and 10.

A gear 48, engaged with the drive wheel 5 fixedly connected to the cannon pinion, is also engaged, in the time-setting position of the winding and time-setting mechanism, with the gear 45*a,* such that the unidirectional rotation movement of the gear 41 is also transmitted to the train of the hour display mechanism, as well as to all the other display mechanisms which can also be linked.

As has been apparent from the preceding description, all changes to the minute and hour display, as well as the display derived from the hour display, namely the day and night indication, are actuated, respectively, by the cam wheel 7 and yokes 8, 11 and by the cam wheel 19 and associated yoke 20.

Figure 2:
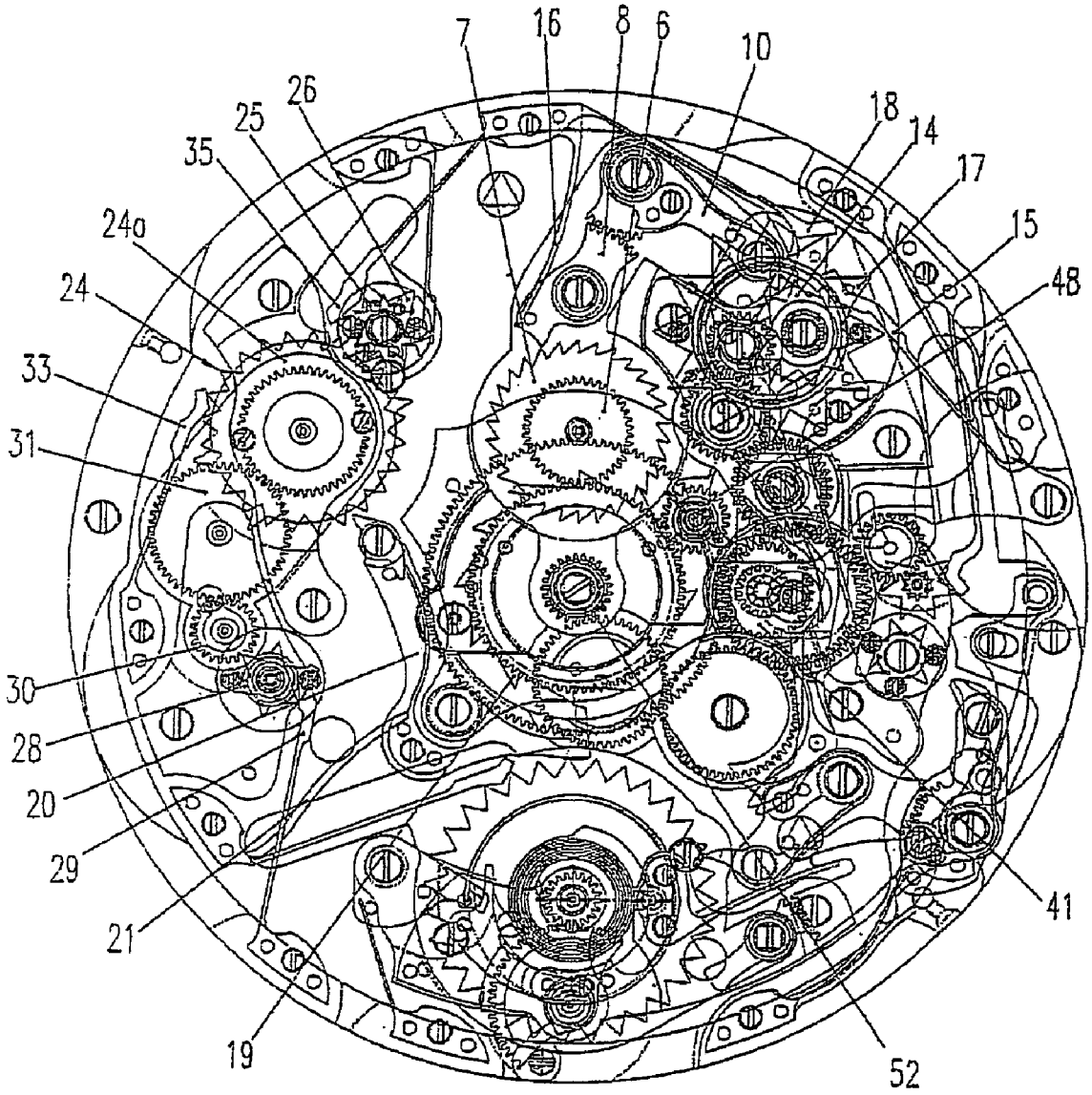
FIG. 2 is a top view similar to that of FIG. 1 but without the different indicator disks, thereby revealing the whole of the display mechanisms of this timepiece.

FIG. 1 shows that the timepiece which is here described also comprises a days of the week display disk 49, a hand 50 for the days of the month display, as well as a disk 51 for displaying the phases of the moon. The driving of these display elements is realized from a pinion 52 (FIGS. 2 and 5) fixedly connected to the hour cam wheel 19, itself fixedly connected to the cannon wheel (not represented) of the usual work train of all mechanical display watches. These mechanisms are of the conventional type and do not form part of the present invention, so that there is no use in describing them here insofar as they are not necessary to an understanding of the present invention.

It is clear that the mechanical display mechanism forming the subject of the present invention must overcome the frictions of the display elements, as well as the energy loss caused by the winding of the springs intended to store sufficient energy to displace the display elements by instantaneous jumps and to surmount the force of the jumper springs for positioning the display disks. It is clear that such a display mechanism can only function if the surface state of the friction surfaces of the different elements of this mechanism allows the greatest possible reduction in frictions. It is thus, in particular, that, in the case of the star wheel 17 fixedly connected to the tens of minutes disk 3, which appears in the form of a ring (FIG. 4), the bearing on which the inner circular surface of this ring pivots will advantageously be made of ruby.

The invention claimed is:

1. A mechanical hour and minute display device, comprising four disks, two for displaying, respectively, the tens and units of hours, two for displaying, respectively, the tens and units of minutes, each disk being fixedly connected to a toothed wheel linked to a positioning jumper spring, said toothed wheels, fixedly connected to the two disks so as to display, respectively, the units of hours and of minutes, being linked to respective yoke mechanisms pressed by elastic means against respective instantaneous-jump cam elements, and further comprises, between said cam elements and said toothed wheels fixedly connected, respectively, to said tens of minutes and of hours disks, means for connecting said toothed wheels to said respective instantaneous-jump cam elements with each change of tens.

2. The device as claimed in claim 1, wherein the rotation axes of said toothed wheels fixedly connected, respectively, to said units and tens of minutes display disks are parallel and arranged so that two respective portions of the toothings of these toothed wheels lie one on top of the other, one tooth in ten of said toothed wheel fixedly connected to said unit display disk having an addendum directed toward the other toothed wheel, whereas each tooth of the latter wheel has an addendum directed toward the other toothed wheel, such that, with each turn of the addendum of said units display wheel, this addendum advances said tens display wheel by one step.

3. The device as claimed in claim 1, in which said toothed wheels fixedly connected, respectively, to said units and tens of hours display disks are concentric, a double-geared mobile being interposed between said yoke mechanism and said wheels, the first gear of said mobile being engaged, on the one hand, with said yoke mechanism arranged so as to advance it by one step per hour and, on the other hand, with said toothed wheel fixedly connected to said units of hours display disk, the second gear of said mobile comprising teeth disposed angularly to mesh with said toothed wheel fixedly connected to said tens of hours display disk with the passage of the tens and every twelve hours.

4. The device as claimed in claim 1, comprising a time-setting mechanism, the train of which comprises means for the unidirectional transmission of the rotation of the winding and time-setting stem.

5. The device as claimed in claim 4, wherein the time-setting mechanism comprises, on the one hand, means for establishing, in the time-setting position of said winding and time-setting stem, a direct connection between the latter and said toothed wheel fixedly connected to said disk in order to display the units of minutes and, on the other hand, means for establishing, in the time-setting position of said winding and time-setting stem, a connection between the latter and said double-geared mobile interposed between said yoke mechanism and said toothed wheels fixedly connected, respectively, to said units and tens of hours display disks.

6. The device as claimed in claim 2, in which said toothed wheels fixedly connected, respectively, to said units and tens of hours display disks are concentric, a double-geared mobile being interposed between said yoke mechanism and said wheels, the first gear of said mobile being engaged, on the one hand, with said yoke mechanism arranged so as to advance it by one step per hour and, on the other hand, with said toothed wheel fixedly connected to said units of hours display disk, the second gear of said mobile comprising teeth disposed angularly to mesh with said toothed wheel fixedly connected to said tens of hours display disk with the passage of the tens and every twelve hours.

7. The device as claimed in claim 2, comprising a time-setting mechanism, the train of which comprises means for the unidirectional transmission of the rotation of the winding and time-setting stem.

8. The device as claimed in claim 3, comprising a time-setting mechanism, the train of which comprises means for the unidirectional transmission of the rotation of the winding and time-setting stem.

9. The device as claimed in claim 7, wherein the time-setting mechanism comprises, on the one hand, means for establishing, in the time-setting position of said winding and time-setting stem, a direct connection between the latter and said toothed wheel fixedly connected to said disk in order to display the units of minutes and, on the other hand, means for establishing, in the time-setting position of said winding and time-setting stem, a connection between the latter and said double-geared mobile interposed between said yoke mechanism and said toothed wheels fixedly connected, respectively, to said units and tens of hours display disks.

10. The device as claimed in claim 8, wherein the time-setting mechanism comprises, on the one hand, means for establishing, in the time-setting position of said winding and time-setting stem, a direct connection between the latter and said toothed wheel fixedly connected to said disk in order to display the units of minutes and, on the other hand, means for establishing, in the time-setting position of said winding and time-setting stem, a connection between the latter and said double-geared mobile interposed between said yoke mechanism and said toothed wheels fixedly connected, respectively, to said units and tens of hours display disks.

* * * * *